US007695591B2

(12) United States Patent
Lundberg et al.

(10) Patent No.: US 7,695,591 B2
(45) Date of Patent: Apr. 13, 2010

(54) ARRANGEMENT AND METHOD FOR TREATMENT OF CELLULOSE PULP INVOLVING MEANS FOR SEAL ADJUSTMENT

(75) Inventors: Jörgen T. Lundberg, Sundsvall (SE); Stefan Mattsson, Kvissleby (SE); Johan Bylander, Sundsvall (SE); Magnus Henriksson, Sundsvall (SE)

(73) Assignee: Metso Paper, Inc. (FI)

( * ) Notice: Subject to any disclaimer, the term of this patent is extended or adjusted under 35 U.S.C. 154(b) by 160 days.

(21) Appl. No.: 11/921,485

(22) PCT Filed: May 31, 2006

(86) PCT No.: PCT/SE2006/050175

§ 371 (c)(1),
(2), (4) Date: Dec. 3, 2007

(87) PCT Pub. No.: WO2006/130109

PCT Pub. Date: Dec. 7, 2006

(65) Prior Publication Data

US 2009/0078382 A1 Mar. 26, 2009

(30) Foreign Application Priority Data

Jun. 3, 2005 (SE) ..... 0501289-3
Dec. 15, 2005 (SE) ..... 0502785-9

(51) Int. Cl.
*D21C 1/10* (2006.01)

(52) U.S. Cl. ..... 162/52; 162/55; 162/252; 162/254

(58) Field of Classification Search ..... 162/52, 162/55, 252, 254, 232
See application file for complete search history.

(56) References Cited

U.S. PATENT DOCUMENTS 4,769,986 A * 9/1988 Kokkonen et al. ..... 68/181 R
4,952,314 A * 8/1990 Henricson et al. ..... 210/404
5,046,338 A * 9/1991 Luthi ..... 68/43
5,192,454 A * 3/1993 Immonen et al. ..... 210/780
5,421,176 A * 6/1995 Ojala et al. ..... 68/43

FOREIGN PATENT DOCUMENTS

WO WO-97/10380 A1 3/1997

* cited by examiner

*Primary Examiner*—Mark Halpern
(74) *Attorney, Agent, or Firm*—Lerner, David, Littenberg, Krumholz & Mentlik, LLP

(57) ABSTRACT

A washing arrangement for washing and dewatering of cellulose pulp is disclosed, comprising a rotatable drum having a plurality of outer compartments defined by axial compartment walls distributed along the circumference of the drum, a stationary cylindrical casing that encloses the drum, whereby an annular space is defined between the casing and the drum and longitudinal seals extending in the axial direction of the drum divide the annular space into zones for forming, washing and discharge of the pulp. The function of the longitudinal seals is optimized by units for seal adjustment having force sensors for measuring a force acting on one of the longitudinal seals in the direction from the drum, and positioners for automatically moving the longitudinal seal substantially in the radial direction of the drum according to a predetermined pattern based on the measured force.

13 Claims, 6 Drawing Sheets

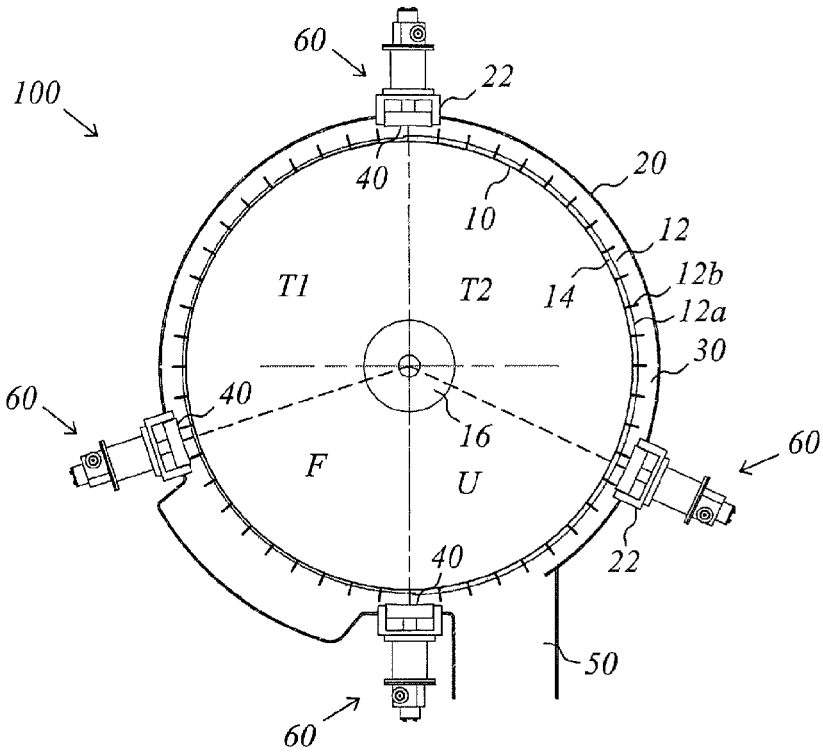
FIG. 3
FIG. 4A
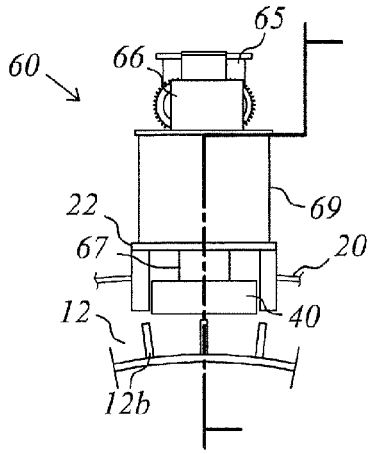
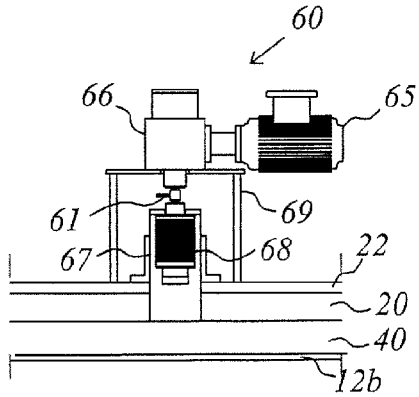
FIG. 4B

ARRANGEMENT AND METHOD FOR TREATMENT OF CELLULOSE PULP INVOLVING MEANS FOR SEAL ADJUSTMENT

This application is a 371 of PCT/SE2006/050175 filed 31 May 2006.

FIELD OF THE INVENTION

The present invention relates to a washing arrangement for washing and dewatering cellulose pulp of the type comprising a compartmented drum.

BACKGROUND OF THE INVENTION

All fiber lines comprise some type of washing equipment to separate the digestion liquor from the pulp. Later on in the process washing equipment is provided to separate bleaching liquors, after bleaching stages. There are a number of different types of washing equipment operating according to different principles.

A well-known type of washing arrangement is the drum washer, where the pulp is dewatered on a rotating filter drum after addition of washing liquid, which displaces the liquor remaining on the pulp web after the preceding process stage, for example a digestion stage or a bleaching stage. An underpressure inside the drum causes the displaced liquid to pass through a perforated metal sheet arranged on the rotatable drum. A further development of the original drum washer is the pressurized displacement washer, where the filtrate, at an overpressure, is brought to pass through the metal sheet. The increase in pressure difference leads to a more efficient filtrate displacement.

According to a known design of a pressurized displacement washer, the drum is provided with compartments, extending in the axial direction of the drum, and intended to be filled with pulp. The compartments are defined by walls in the form of bars arranged axially along the entire drum shaft, as well as a bottom formed by the perforated metal sheet. The compartmentalization of the drum ensures that the pulp cake does not break up and get transported away, but instead maintains the shape which is produced upon application of the pulp. The perforated metal sheet, on which the pulp is deposited, is located at a distance from the main surface of the drum, so that filtrate channels are formed in the space between the drum and the metal sheet. Along the circumference of the drum there are at least as many filtrate channels as pulp compartments.

In a drum washer, a plurality of different washing stages can be carried out, with separate addition of washing liquid to the different stages, as well as re-cycling of filtrate from one stage for use as washing liquid in another stage. In order to achieve maximum washing efficiency, it is desirable that washing liquid intended for a particular washing stage is not transferred to a later washing stage. (Due to pressure differences between the stages, the supplied washing liquid tends to be transported towards the lower pressure.) In order to be able to separate different washing stages, which are carried out in one or more washing zones of the drum, and forming stages, which are carried out in the forming zone of the drum, and discharge stages, which are carried out in a discharge zone of the drum (a zone for enhanced pulp concentration constitutes a first part of the discharge zone), the respective zones are sealed by longitudinal (i.e. axially extending) seals. These longitudinal seals are arranged between the rotary drum and the surrounding casing. The filtrates from the respective zones are separated by seals in a peripheral end valve arranged at one or both of the end walls of the drum.

A problem associated with drum washers of the type that has zones separated by means of longitudinal seals is that these seals are exposed for abrasion, wear and other stresses. The seals change over time, which affects the general wash performance in a negative manner and also leads to risks of leakage and production interruptions.

According to the prior art, it is possible that the working staff can make manual adjustments of the longitudinal seals. The principle is to wheel the seal in the direction towards the drum until the staff perceives a sound which serves to indicate that the seal lies in close contact with the drum, and thereafter back the seal off by an arbitrary distance. This procedure is circumstantial, irregular and completely dependent on personal qualities of the working staff.

Accordingly, there is a need for an improved solution to the problem with seals that are worn and change over time.

One object of the present invention is to provide an improved washing apparatus of the kind with a compartmented rotatable drum. In particular, the present invention aims at accomplishing a more secure and more effective seal mechanism of the washing apparatus.

SUMMARY OF THE INVENTION

In accordance with the present invention, these and other objects have now been realized by the invention of a controller for use in a washer for washing and dewatering cellulosic pulp material comprising a rotary drum including a plurality of axial compartment walls extending along the rotary drum so as to create a plurality of external axial compartments for washing the cellulosic pulp material, a stationary cylindrical casing enclosing the rotary drum thereby defining a ring-shaped space between the rotary drum and the stationary cylindrical casing, a plurality of axially extending seals disposed along the rotary drum thereby dividing the ring-shaped space into a plurality of zones for feeding, washing and discharging the cellulosic pulp material, the controller comprising a force sensor for sensing a force acting on at least one of the plurality of axially extending seals in a direction outwardly from the rotary drum and a seal positioning member for moving the at least one of the plurality of axially extending seals in the radial direction with respect to the rotary drum in a predetermined pattern based upon the force measured by the force sensor. Preferably, the seal positioning member is adapted to reverse the direction of movement of the at least one of the plurality of axially extending seals a predetermined distance if the force measured by the force sensor exceeds a contact threshold force. In a preferred embodiment, the seal positioning member is adapted to move the at least one of the plurality of axially extending seals in a direction towards the rotary drum based on a comparison of the force measured by the force sensor and a first contact threshold force and reverse the at least one of the plurality of axially extending seals a first predetermined distance when the first contact threshold force has been exceeded in a first mode of operation, and to reverse the at least one of the plurality of axially extending seals a second predetermined distance when the force measured by the force sensor exceeds a second contact threshold force. Preferably, the seal positioning member is adapted to reverse the at least one of the plurality of axially extending seals when the force measured by the force sensor exceeds at least one of the first and second contact threshold forces for a predetermined period of time.

In accordance with one embodiment of the controller of the present invention, the controller comprises at least two of the force sensors associated with the at least one of the plurality of axially extending seals, and at least two corresponding seal positioning members associated therewith, and includes a pivoted connection between each of the seal positioning members and the at least one of the plurality of axially extending seals, whereby different portions of the at least one of the plurality of axially extending seals can be moved independently with respect to the other of the plurality of axially extending seals.

In accordance with one embodiment of the controller of the present invention the force sensor comprises a load cell.

In accordance with another embodiment of the controller of the present invention, the seal positioning member comprises a holder for holding the at least one of the plurality of axially extending seals in a radial position with respect to the rotary drum and a drive member for driving the at least one of the plurality of axially extending seals by driving the holder. Preferably, the seal positioning member further comprises a spring force member in cooperative association with the driving member, whereby the spring force member becomes active when the driving member has reached a predetermined maximum capacity.

In accordance with another embodiment of the controller of the present invention, the seal positioning member is adapted to move the at least one of the plurality of axially extending seals based on at least one pressure associated with the at least one of the plurality of axially extending seals.

In accordance with another embodiment of the controller of the present invention, the controller includes a control member for collecting the force measured by the force sensor and transmitting a control signal based thereon to the seal positioning member.

In accordance with the present invention, a washer has also been provided for washing and dewatering cellulosic pulp material comprising a rotary drum including a plurality of axial compartment walls extending along the rotary drum so as to create a plurality of external axial compartments for washing the cellulosic pulp material, a stationary cylindrical casing enclosing the rotary drum thereby defining a ring-shaped space between the rotary drum and the stationary cylindrical casing, a plurality of axially extending seals disposed along the rotary drum thereby dividing the ring-shaped space into a plurality of zones for forming, washing and discharging the cellulosic pulp material, and a controller comprising a force sensor for sensing a force acting on at least one of the plurality of axially extending seals in a direction outwardly from the rotary drum and a seal positioning member for moving the at least one of the plurality of axially extending seals in the radial direction with respect to the rotary drum in a predetermined pattern based on the force measured by the force sensor.

In accordance with the present invention, a method is also provided for controlling a washer for washing and dewatering cellulosic pulp material comprising a rotary drum including a plurality of axial compartment walls extending along the rotary drum so as to create a plurality of external axial compartments for washing the cellulosic pulp material, a stationary cylindrical casing enclosing the rotary drum thereby defining a ring-shaped space between the rotary drum and the stationary cylindrical casing, a plurality of axially extending seals disposed along the rotary drum thereby dividing the ring-shaped space into a plurality of zones for forming, washing and discharging the cellulosic pulp material, the method comprising measuring a force acting on at least one of the plurality of axially extending seals in a direction outwardly from the rotary drum and moving the at least one of the plurality of axially extending seals in a radial direction with respect to the rotary drum in a predetermined pattern based on the force measured by the force sensor. Preferably, the moving of the at least one of the plurality of axially extending seals comprises reversing the direction of movement of the at least one of the plurality of axially extending seals a predetermined distance when the measured force exceeds a contact threshold.

In accordance with the present invention, there is provided a compartmented washing apparatus with adjustment of at least one longitudinal (i.e. axially extending) seal based on the force that acts on the seal in a direction radially outwardly from the drum. The force is measured, for example with a load cell or the like, and based thereon the seal is moved when necessary, for example when the seal gets too close to the drum due to wear or deformation of the drum or when there is an unfamiliar object between the seal and the drum. Preferably, this is achieved by comparing the measured force with a contact threshold value, whereby exceeding the threshold is interpreted as an indication that the seal lies in contact with the drum (i.e. is too close to the drum). The movement of the seal is accomplished by means of a motor, hydraulics or another drive means, normally connected to the seal over one or more intermediary members and/or positioning means.

The proposed seal adjustment enables washing apparatuses with "self sensing" seal arrangements where the seal is automatically moved back (reversed) upon contact with the drum. The seal adjustments can thus be performed independent of the personal qualities and perceptional abilities of the working staff. Among other things, the present invention enables compensation for changes in the position of the longitudinal seals in relation to the drum as a result of deformations of the drum washer upon changed operational conditions. A more secure sealing function is obtained, the risk of leakage is considerably reduced, and operation of the washer drum can be optimized such that the washing process provides better results.

Thus, according to the present invention there is provided a washing arrangement for washing and dewatering of cellulose pulp, which washing arrangement comprises a rotatable drum with a plurality of outer compartments on the drum for the pulp to be washed, which compartments are defined by axial compartment walls distributed along the circumference of the drum, a stationary cylindrical casing which encloses the drum, whereby an annular space is defined between the casing and the drum, and where the annular space, by means of longitudinal seals in the axial direction of the drum, is divided into zones for forming, washing and discharge of the pulp, the washing arrangement comprising a unit for seal adjustment with measuring means for measuring a force acting towards one of the longitudinal seals in a direction from the drum and moving means for moving the longitudinal seal substantially in the radial direction of the drum according to a predetermined pattern based on the force measured by the measuring means.

The moving means is preferably adapted to reverse the longitudinal seal in a predetermined manner, for example a predetermined distance, if the measured force exceeds a contact threshold. According to a preferred embodiment, the moving means is in this respect adapted to, in a first mode of operation, bring the seal in a direction towards the drum while comparing the measured force against a first contact threshold, whereby the seal is reversed a predetermined distance after the first contact threshold has been exceeded, and, in a second mode of operation, reverse the longitudinal seal a predetermined distance if the measured force exceeds a second contact threshold.

Furthermore, there may be at least two measuring means arranged in connection with the longitudinal seal together with a respective individually controlled moving means. By means of a pivoted (articulated) connection between the moving means and the seal, different parts of the seal may be moved independent of each other.

According to a particular embodiment of the present invention, the moving means comprises a positioning means that holds the seal in the radial direction of the drum, as well as drive means that drives the movement of the seal by, directly or indirectly, affecting the positioning means. The moving means may further comprise a spring force-based means, which is adapted to co-operate with the drive means such that the spring force-based means comes into force when the maximum capacity of the drive means is reached. Moreover, there is a control unit which is arranged to collect a force signal from the measuring means and transmit a control signal to the moving means based on the force signal.

According to other aspects of the present invention, a unit for seal adjustment is provided, and also a method for seal adjustment.

BRIEF DESCRIPTION OF THE DRAWINGS

The present invention, as well as further objects and advantages thereof, is best understood by reference to the following detailed description, which in turn refers to the attached drawings, wherein:

FIG. 3 is a side, elevational, cross-sectional, partially schematic view of a washing apparatus with a compartmented drum in accordance with a preferred embodiment of the present invention;

FIG. 4A is a front, elevational, partial, cross-sectional view of a part of a washing apparatus having a longitudinal seal as well as a unit for seal adjustment in accordance with a preferred embodiment of the present invention;

FIG. 4B is a side, elevational, partial, cross-sectional view of the part shown in FIG. 4A;

DETAILED DESCRIPTION

Figure 1:
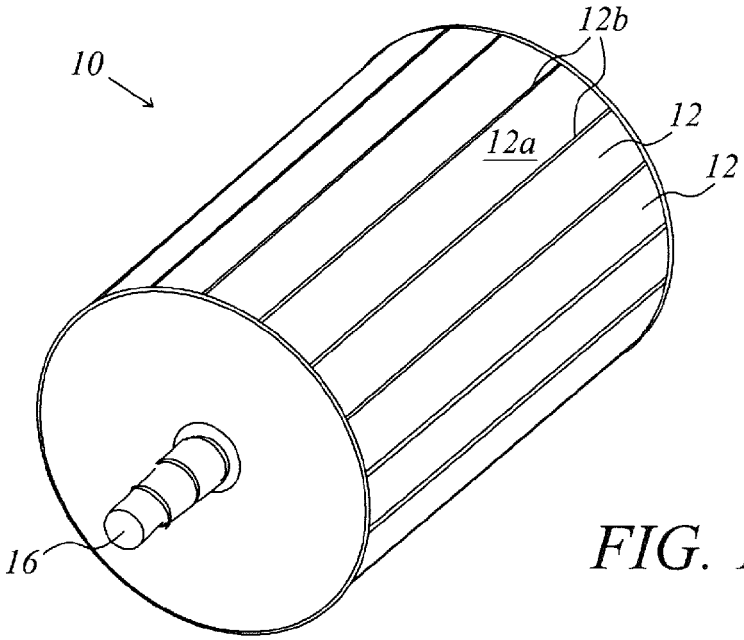
FIG. 1 is a side, schematic, perspective view of a compartmented rotatable drum that can be used in a washing apparatus according to the present invention.

Throughout the drawings, the same reference numbers are used for similar or corresponding elements, referring to FIG. 1 is a schematic perspective view of a compartmented rotatable drum that can be included together with a stationary casing in a pressurized displacement washer according to the present invention. A rotatable drum 10 provided with a plurality of outer compartments (also referred to as pulp compartments or cells) 12 is shown, in which compartments the paper pulp to be washed is placed during feeding towards the drum. Each compartment 12 has a bottom 12*a* of perforated metal sheet, as well as two compartment walls (cell walls) 12*b* arranged axially with reference to the shaft 16 of the drum. The compartment walls 12*b* of the drum illustrated in FIG. 1 are evenly distributed along the circumference of the drum. The rotatable drum 10 is in general rotatably mounted on a stationary support (not shown) in the washing apparatus and is enclosed by a cylindrical casing (20 in FIG. 2 e.g.), whereby an annular space 30 is defined between the casing and the drum.

Figure 2:
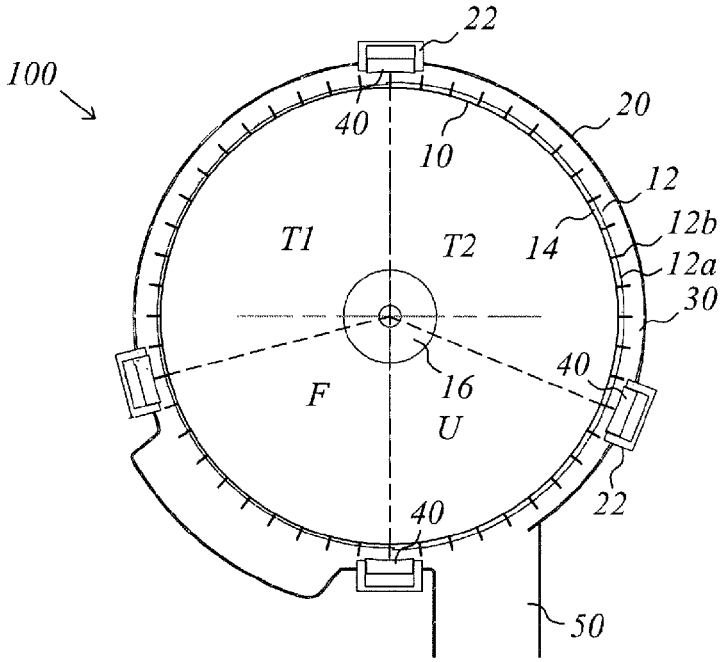
FIG. 2 (Prior art)
FIG. 2 is a side, elevational, cross-sectional, partially schematic view of a prior-art washing apparatus with a compartmented drum.

FIG. 2 shows an axial cross-section through a washing apparatus with a compartmented rotatable drum according to the prior art. The washing apparatus 100 comprises a plurality of axial longitudinal seals 40 arranged between the rotatable drum 10 and the surrounding casing 20. These longitudinal seals 40 create seals between the casing 20 and the compartment walls 12*b* of the compartments and serve as separating members between different zones, F, T1, T2, and U, of the washing apparatus 100. The function of the seals 40 is of great importance e.g. in order to ensure that washing liquid intended for a specific washing stage is not moved to a subsequent washing stage, particularly since there is normally a difference in pressure between different washing stages. In FIG. 2 four longitudinal seals 40 are shown, thus dividing the annular space 30 into four zones, more specifically into a forming zone F for forming the pulp onto the compartments 12 of the drum, a first and a second washing zone, T1 and T2, for washing the formed pulp, and a discharge zone U for discharging the washed pulp.

Each seal 40 has a width which is somewhat larger than the distance between two adjacent compartment walls 12*b*. Consequently, the compartment walls 12*b* will pass the seal 40 one by one as the drum 10 rotates and the position of the seal is such that at each point in time it "covers" either one or two compartment walls 12*b*. Further, the seal may, for example, extend in principle in the axial direction along the entire drum. Alternatively, the drum may present two (or more) separate seals in the axial direction, such as when the drum is provided with an annular structure that divides every compartment into two sub-compartments in the axial direction, whereby the filtrate can be conducted away from both of the end walls of the drum.

The rotatable drum 10, including the compartment walls 12*b* thereof, is normally made of steel. The longitudinal seals 40 may also be made of a metal material, but can with advantage be made in a polymer material, intended to be replaced by means of particular opening parts 22 in the casing 20.

A drum washer 100 of the above described design is run with continuously rotating drum 10 according to the following principle. Pulp to be washed is fed into the forming zone F (the inlet is not shown), whereby the pulp is placed in the compartments 12 of the drum 10 forming, in the axial direction of the drum, long and narrow rectangles on the perforated metal sheet which constitutes the bottom of the compartments 12*a*. The compartmentalization of the drum makes sure that the formed pulp cake structure is maintained. Washing liquid is supplied to the annular space 30 and filtrate is squeezed out of the pulp and thereby passes through the perforated metal sheet. Preferably, this occurs under an overpressure in order to obtain an improved dewatering of the pulp. The perforated metal sheet is placed at a distance from the drum 10 such that filtrate channels 14 are formed in the space between the drum 10 and the perforated metal sheet. The washing may, as in FIG. 2, be repeated in two or more stages at different pressures and using separate washing liquids. Used liquid is usually brought back to a preceding washing stage, or led out of the washing apparatus 100 to a previous process stage. The washed pulp is discharged through an outlet opening 50.

As mentioned in the background section, the longitudinal seals of the drum wash are exposed to abrasion, wear and other stresses. The seals change over time, which affects the general washing performance in a negative way and also leads to risks of leakage and operational interruptions. Occasionally, various objects, such as chips or metal sheet parts, may also enter between a seal and the drum, whereby the function of the seal is considerably impaired and leakage may arise. As mentioned in the background section, in such cases the prior art suggests manual adjustments of a more or less arbitrary nature.

In particular, it has been observed that the position of the longitudinal seals of the drum washer is altered and displaced in response to varying conditions of operation. Varying conditions of operation may imply considerable differences in pressure and/or temperature in the washing apparatus, whereby the drum washer presents deformations. Thereby, the respective seal positions change in relation to the drum and the sealing function is affected in a negative way. The aforementioned manual adjustments are particularly unreliable in respect of adjustments for these kinds of changes, which sometimes appear comparatively fast and in an unpredictable way.

According to the present invention, a mechanism for seal adjustment is proposed, which mechanism enables a more sophisticated handling of the longitudinal seals of the washing drum. FIG. 3 shows a washing apparatus 100 in a cross-sectional view where units 60 for seal adjustment in accordance with the present invention have been arranged in association with the longitudinal (axial) seals 40. Each unit 60 for seal adjustment comprises a measuring means for measuring the force that acts on the seal 40 in a direction from the drum 10 and also a moving means for subsequent movement of the seal 40 according to a predetermined pattern based on the measured force. The force will in principle remain unchanged, or at least fluctuate around a certain value/range, when the seal 40 is not in contact with the compartment walls 12*b* of the drum. When the seal 40 gets so close that it lies in contact with (bears against) the compartment walls 12*b*, the force is strikingly changed, which can be referred to as a contact force acting away from the drum 10 towards the seal 40. These conditions are, according to the present invention, used, by means of the moving means, in order to reverse the seal 40 (e.g. move it outwardly, as seen radially) to a desired position when it is too close to the drum 10.

The proposed seal adjustment is preferably "self sensing" and automatic in the sense that the seal is automatically reversed, for instance upon contact with the drum. The seal settings do not depend on the working staff's personal qualities and apprehension. The present invention enables compensation for changes in the position of the longitudinal seals in relation to the drum due to varying conditions of operation and deformations of the drum washer. Such compensation, as well as compensation for wear and other seal changes, may thus be carried out automatically.

It should be emphasized that expressions used in this description, such that the seal is in contact with or lies in (close) contact with or bears against the compartment walls/drum and the like, refers to direct as well as indirect contact between seals and compartment walls. Thus, there does not necessarily have to be any physical contact directly between the seal and the compartment walls/drum for these conditions to be fulfilled. For example, the seals may be arranged at a certain distance from the drum and its compartment walls, whereby the contact arising from the meeting with the compartment walls occurs by means of the pulp compressed in the compartments. It can also be the case that there is an object, such as a chip or a metal sheet part, between the seal and the compartment walls.

A preferred embodiment of the unit 60 for seal adjustment will now be described with reference to FIGS. 4A and 4B, which show a part of a washing apparatus with a unit for seal adjustment in an axial and radial cross-section, respectively. A longitudinal seal 40 of the kind that seals between zones in the washing drum 10 is shown in a position where it is in contact with a compartment wall 12*b*. The illustrated unit 60 for seal adjustment comprises an induction motor 65, a jackscrew 66, a cylinder 67, a spring package 68 and a load cell 61.

A support structure 69, such as a shelf, encloses the load cell 61, the spring package 68 and also a part of the cylinder 67. The cylinder 67 works as a positioning means and holds the longitudinal seal 40 in the radial direction as seen from the drum. Movement of the seal 40 in a substantially radial direction is driven by the electrical motor 65, the rotational movement of which is translated to linear movement by means of the jackscrew 66. The jackscrew 66 is connected to the cylinder 67 and in this way the driving power of the motor 65 is transferred to the seal 40. (The function of the spring package 68 is described below.) The task of the load cell 61 is to measure the force acting on the seal 40 in a direction substantially radially out from the drum 10. In order to achieve this, it is suitably arranged between the cylinder 67 and the jackscrew 66, as in the example.

An advantage of the force-based seal adjustment according to the present invention is that it may be implemented by essentially mechanical measuring equipment, at least in respect of the parts that are arranged within the casing of the washing apparatus. The adjustment unit is therefore suitable for use in the demanding environment in the washing apparatus, where pulp suspension may be present between the seal and the drum.

The load cell 61 as well as the motor 65 are preferably connected to a control unit/function (63 in FIG. 8), which for example can be implemented in the form of computer executable algorithms. The control unit collects measured values from the load cell 61, and based thereon, generates control settings for the motor 65 in a predetermined way. This preferably includes comparing the measured force against at least one threshold value, also referred to as contact threshold. If the measured force exceeds the threshold, the control unit controls the motor 65 such that it moves the seal, by means of the jackscrew 66 and the cylinder 67, in a direction away from the drum.

The seal adjustment according to the present invention may with advantage be provided with a positioning function for positioning the seal at the correct distance from the drum at selected points of time as well as with a function that reacts by moving the seal at the occasions when it comes too close to the drum during "normal operation".

Figure 5A:
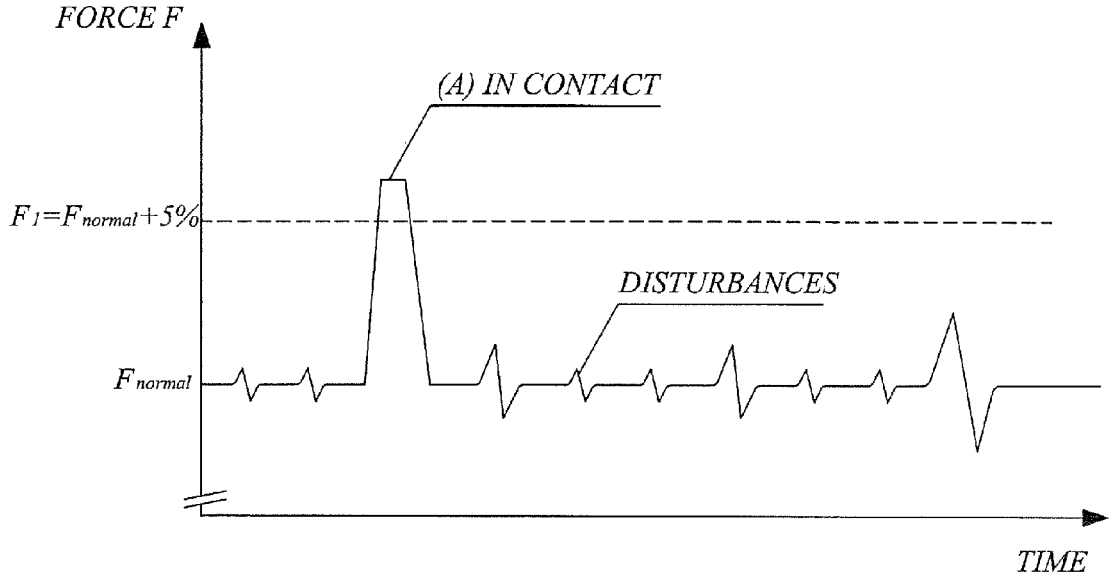
FIG. 5A is a simplified diagram of the force that is measured according to the present invention as a function of time with contact thresholds indicated to illustrate the first and second adjustment functions in accordance with a preferred embodiment of the present invention.

The first-mentioned function, the positioning function, may for example be adapted to adjust the seal in the following way. Starting from the start/zero position of the system, the seal is moved in a direction towards the drum until a force greater than a contact threshold $F_1$ is recorded by the measuring means. $F_1$ is chosen such that it serves as an indication of the fact that the seal has come into contact with (bears against) the drum. This means that the value $F_1$ should be different from the force range which the force on the seal lies within when there is no contact with the drum, but at the same time not be unnecessarily large in order to avoid undesired contact between the seal and the drum. This is illustrated in FIG. 5A, where $F_1=1.05 \cdot F_{normal}$ and $F_{normal}$ represents the average force on the seal in a normal position, i.e. without contact. When $F_1$ is registered (position A), the system reverses the seal so that the distance between the drum and the seal falls within a desired range, for example in the magnitude of ten parts of a millimeter to a millimeter. In order not to cause unnecessarily great wear on the seal and the drum, the rate of the movement should be adapted to the response of the individual motor used.

The described positioning procedure is suitably repeated at certain intervals and may also according to some embodiments be initiated, by the working staff in between these points of time. It has been observed that the warming up of the washing drum leads to considerable geometrical deformations, whereby the distance between the drum and the longitudinal seal can vary by as much as several millimeters. This results in problems in the form of an impaired sealing function with less good washing results as well as an enhanced risk of leakage and production interruptions during the period of heating. According to an advantageous embodiment of the present invention, it is therefore proposed to adapt the system for seal adjustment, upon start-up with a cold machine, during a certain period of time performing positioning at more frequent points of time (e.g. at time intervals in the magnitude of hours), and thereafter switch to the same mode of operation with regard to positioning as upon start-up with a warm machine (e.g. with time intervals in the magnitude of days). Variants with two positioning modes are possible and so are variants with a successive increase of the positioning intervals. In this way, a well-functioning and safe seal between the zones of the drum is also achieved during the initial phase of the washing process, e.g. after a comparatively long interruption in the operation.

The second function mentioned above, which reacts upon contact, may for example be arranged to adjust the seal in the following way. The measuring means registers the force acting on the longitudinal seal in a direction away from the drum, more or less continuously. When the force exceeds a contact threshold $F_2$, the system responds by backing the seal off. The threshold $F_2$ is selected as a clear indication of the fact that the seal lies in contact with the drum, directly or by means of some object between the seal and the drum. Generally, $F_2$ is chosen such that $F_2>F_1$, as illustrated in the diagram in FIG. 5B, where $F_2=1,2 \cdot F_{normal}$ and $F_{normal}$ represents the average force at a position without contact. If $F>F_2$ (position B), the seal is reversed a certain distance. However, there may be situations where this is not enough in order to lower the force, for instance if there is still an unfamiliar object between the seal and the drum. According to an embodiment of the present invention, the system is arranged such that the seal in such cases is further reversed (in one or more stages), for example all the way back to the starting position. Preferably, the system is arranged such that this second function is activated as soon as the system is not in its positioning mode. After the adjustment, the system preferably returns to a previous mode of operation or, alternatively, to positioning mode, to be reset.

The input parameters to an algorithm for seal adjustment used in accordance with the present invention in order to perform the above-described functions, typically include the measured force against the seal as well as the position of the seal in relation to the start/zero position. Also, the distance of movement from the position where the seal touches the drum can be used. However, it should be noted that in these cases it is a question of relative positions and distances. With the force measurement according to the present invention, there is no need for a direct distance determination (distance sensor), whereby a seal adjustment that is sophisticated and at the same time comparatively easy to implement is possible. Yet another advantage of the proposed force-based seal adjustment is that it has a built-in correction for the wear on the seal. In other words, there will be an automatic adaptation to the degree of wear on the seal without the need for additional measurements or adjustments.

Figure 6:
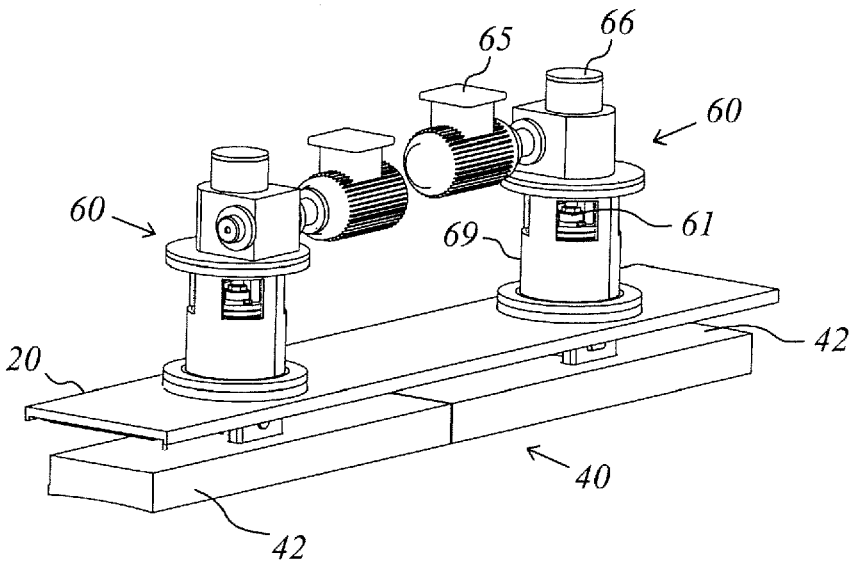
FIG. 6 is a side, perspective view of a longitudinal seal provided with two units for seal adjustment in accordance with a preferred embodiment of the present invention.

According to one embodiment of the present invention, the mechanism for seal adjustment comprises more than one unit for seal adjustment per seal. This is illustrated in FIG. 6, which shows a longitudinal seal 40 provided with two units 60 for seal adjustment, one in the vicinity of each end. These units 60 are preferably provided with functionally separate, i.e. individually controlled, moving means, whereby different parts 42 of the seal 40 can be moved independently of each other. (The moving means in FIG. 6 is partly surrounded by the support structure 69, but its motor 6S and jackscrew 66 are shown.) In this way, an appropriate seal is also achieved in situations where the seal 40 is e.g. unevenly worn or where there are objects between the seal 40 and the drum (10 in FIG. 4A) that only influence a part of the seal 40. In order to facilitate movement of the respective seal part 42, the connection between the cylinder and the seal 40 is in this case preferably pivoted. The movement of the cylinder is still substantially in the radial direction of the drum.

As mentioned, the longitudinal seal 40 is, according to a preferred embodiment, made of a polymer material. Hereby, a supporting meal sheet or the like (not shown) of a more rigid material may be arranged in connection with the seal in order to prevent unwanted bending thereof. Embodiments where there are intermediate parts between the seal and the casing 20 thus lie within the scope of the present invention.

Figure 5B:
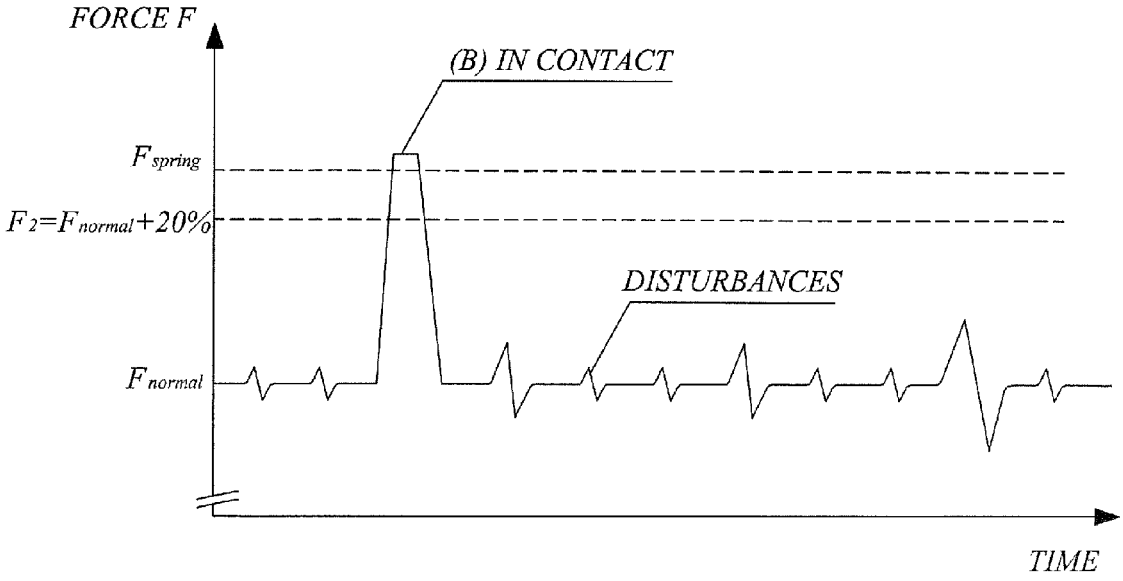
FIG. 5B is a simplified diagram of the force that is measured according to the present invention as a function of time with contact thresholds indicated to illustrate the first and second adjustment functions in accordance with a preferred embodiment of the present invention.

Again referring to FIGS. 4A and 4B, the unit 60 for seal adjustment according to the present invention is preferably provided with a spring means 68, typically arranged such that it encloses the cylinder 67 with a movable part closest to the drum 10 and a fixed point furthest away from the drum 10. The spring package 68 is suitably biased such that it can come into force and provide a rapid movement of the seal 40 away from the drum when the capacity of the motor 65 is not enough. This is illustrated in FIG. 5B, where the threshold for the spring washers $F_{spring}>F_2$. This solution implies that the motor (or an alternative drive means) can be of a manageable size. Another function of the spring means is that it works as a rough emergency measure in order to move the seal, for instance in case the motor is not working and an object enters between the seal and the drum. However, it should be understood that the spring is an optional part of the seal adjustment, which according to some embodiments may be excluded.

According to a preferred embodiment, one or more pressures in the washer drum are used as additional input parameters based on which the position and movement of the seal is controlled. In particular, those of the longitudinal seals of the drum that seal between air (atmospheric pressure) on one side and pulp/liquid on the other side can be affected by a pressure difference which will influence the measured force towards the inner side of the seal (i.e. the side closest to the drum). Disturbances on the force signal due to pressure changes are illustrated in FIGS. 5A and 5B. If the seal is subjected to different pressures against its outer side, the contact thresholds may need to be correspondingly adjusted. Therefore, the pressure according to this exemplifying embodiment is measured in the vicinity of the side surfaces and the outer side of the seal, and then used to determine how to adjust the seal. By taking said pressures in the surroundings of the seal into account, a still more precise determination of the point of time when the seal should be moved is possible, whereby the function of the seal is optimized further and unwanted contact between the seal and the compartment walls is avoided.

Yet another embodiment of the present invention provides a more safe sealing function of the washing drum in cases where there are a plurality of units 60 for seal adjustment. The units 60 may be arranged in association with the same (FIG. 6) or different seals (FIGS. 3 and 7) and during normal operation they operate independently of each other without any communication between them. However, according to this embodiment it is suggested that the control of one seal 40, e.g. when its accompanying load cell 61 is not functioning, can instead be based on the force that is measured with respect of another seal 40/seal part 42. Preferably, the control function is designed such that, when force measurements from one load cell 61 are not available, it first uses the force from another load cell measuring on the same seal. If there is no such load cell or if it does not work, measurement values from a load cell measuring on another seal of the washing drum are used instead. Although the seal adjustment will in general not be as precise as when all load cells are working, it will in this way be better as compared to the case where the self-sensing seal function would be completely disconnected.

Figure 7:
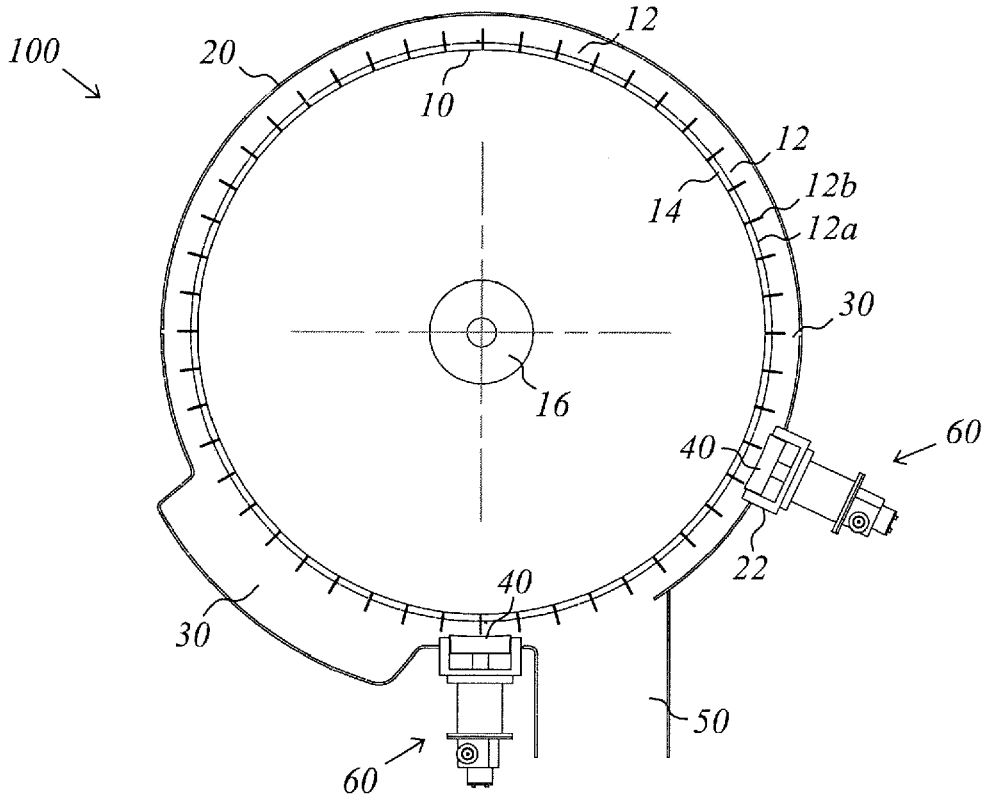
FIG. 7 is a side, elevational, cross-sectional view of a washing apparatus having a compartmented drum in accordance with a preferred embodiment of the present invention.

There may also be embodiments where some longitudinal seals of the washing apparatus are provided with units for seal adjustment while others lack this functionality. Of course, such embodiments also lie within the scope of the present invention. In general, it is most important to optimize the function of the seals which are adjacent to a forming zone and discharge zone, respectively, of the drum. Consequently, according to an embodiment of the present invention, as illustrated in FIG. 7, there is seal adjustment according to the present invention only in association with the first and the last seal of the washing apparatus.

Figure 8:
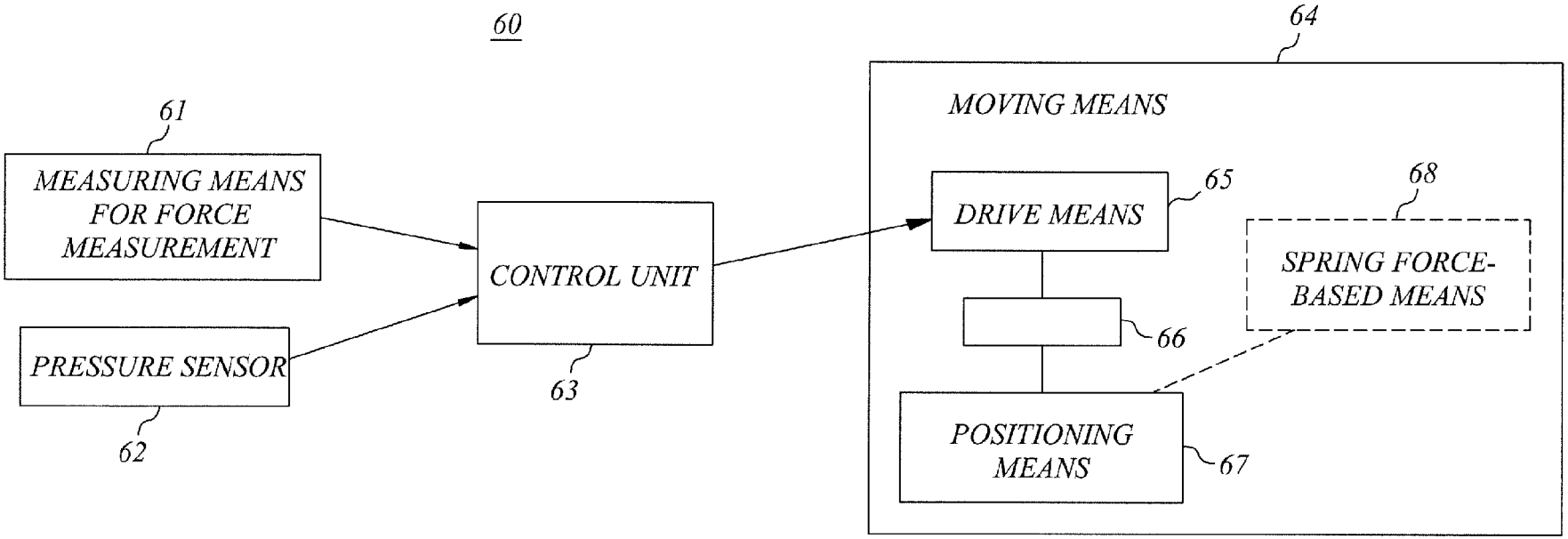
FIG. 8 is a schematic block diagram of a unit for seal adjustment in accordance with a preferred embodiment of the present invention.

FIG. 8 is a schematic block diagram of a unit for seal adjustment according to a preferred embodiment of the present invention. The illustrated unit 60 for seal adjustment comprises a measuring means 61 for force measurement, e.g. a load cell, from which measurement signals are brought to a control unit/function 63, e.g. a computer program with specifically adapted control algorithms. This may take place either on command or automatically at selected time intervals. The control unit 63 in turn communicates with a drive means 65, which drives the movement of the seal and thus forms a part of the moving means 64 of the unit 60. The drive means 65 can, for example, consist of an electric motor or a hydraulic drive means. The position of the seal is controlled by transferring the drive movement of the drive means 65 to a positioning means 67, e.g. a cylinder physically connected to the seal and arranged to hold the seal in the desired position in a substantially radial direction. This can be done directly or by means of one or more intermediary members 66. An example of such an intermediary member is the jackscrew in FIGS. 4A and 4B, but, for example, depending on the nature of the drive means 65, other functional units may be used to translate the drive force to movement of the positioning means 67.

As mentioned above, the moving means 64 can also comprise a spring force-based means 68, which, by means of the positioning means 67, moves the seal when the upper capacity of the drive means 65 is reached. The spring force-based means 68 may often be excluded, which in FIG. 8 is indicated by dashed lines. Furthermore, the moving means can, according to some embodiments, be adapted for movement of the longitudinal seal based also on one or more pressures in the area around the seal. The illustrated adjustment unit 60 includes a unit 62 for pressure measurement, which communicates with the control unit 63 in order to enable seal adjustment based also on one or more pressures in the surroundings at the side surfaces or the outer side of the seal.

Figure 9:
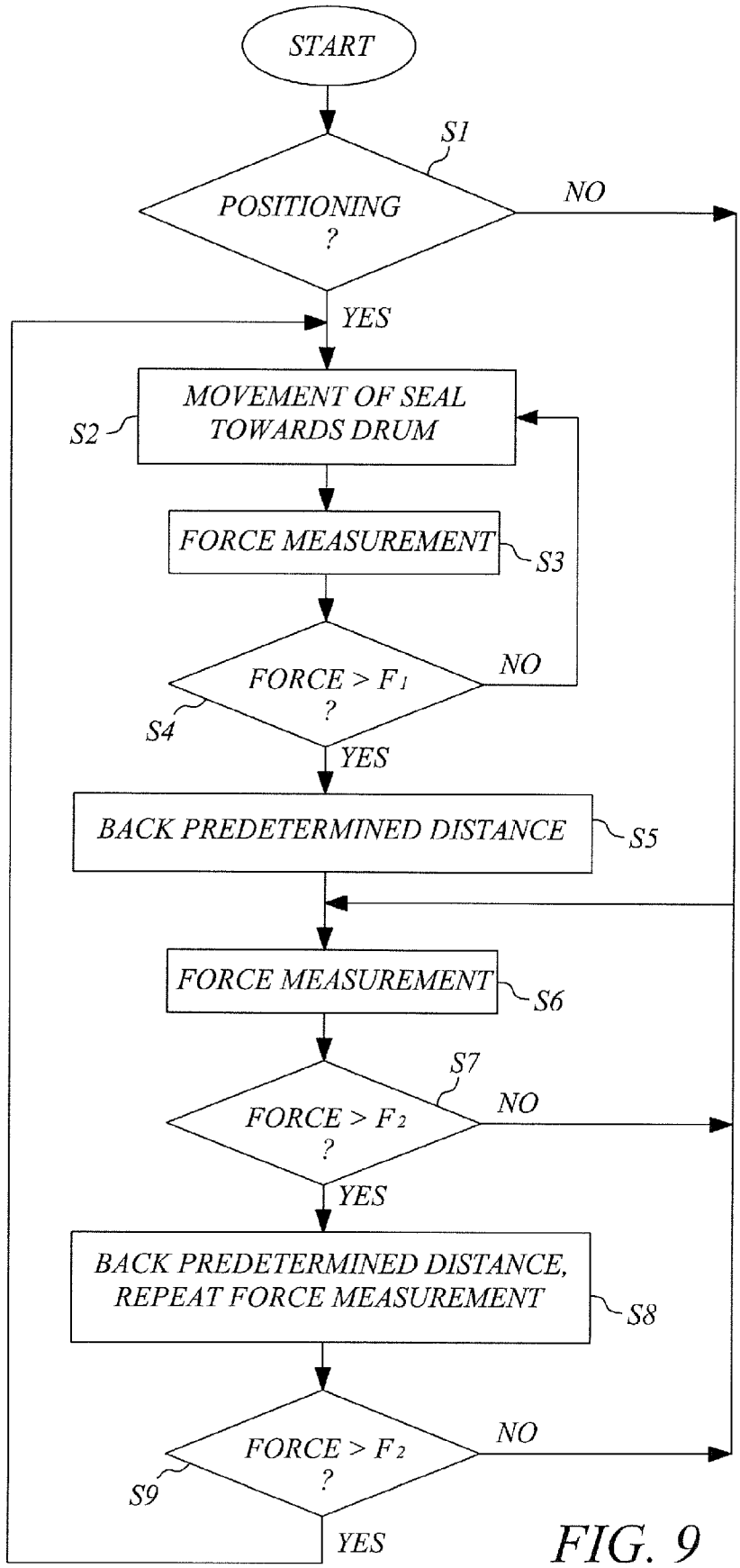
FIG. 9 is a schematic flow chart of a method for seal adjustment in accordance with a preferred embodiment of the present invention.

FIG. 9 is a flow chart of a method for seal adjustment according to a preferred embodiment of the present invention. In a first step S1, it is asked if the system is to be positioned. If this is the case, the procedure continuous with step S2, but if positioning is not required it directly proceeds to step S6. The positioning of step S2 to S5 implies that the seal is moved towards the drum (S2) during measurement of the force that acts on the seal in a direction outwardly from the drum (S3). When a first contact threshold $F_1$ is exceeded, the seal is moved back a predetermined distance by means of the moving means (S5).

A system where positioning is not required or, alternatively, already has been performed, enters a second mode of operation, which in FIG. 9 is exemplified by the steps S6-S9. Force measurement is carried out by more or less continuous monitoring (S6) and the measured force is compared to a second contact threshold $F_2$ in step S7. The contact thresholds $F_1$ and $F_2$ are in general selected such that $F_2>F_1$ but cases where $F_2=F_1$, for example, are also possible within the scope of the present invention. When the limit $F_2$ is exceeded, the system responds with an appropriate measure and moves the seal according to a predetermined pattern. In the illustrated example a first action, according to step S8, reverses the seal a predetermined distance and repeats the force measurement in order to see if the seal is now at a sufficient distance from the drum. This is checked by means of a new comparison between the measured force and the contact threshold $F_2$ in step S9. If the measure was sufficient in order to lower the force, the system can go back to its normal mode of operation, with force monitoring (S6). If the measured force, on the other hand, is still larger than $F_2$, the system of FIG. 9 enters the positioning mode for re-positioning the seal.

It is to be understood that the above-described method for seal adjustment can be varied within the scope of the present invention. The measures taken when the contact thresholds are exceeded can, for example, be different. According to a preferred embodiment it is only when the contact threshold has been exceeded for a certain predetermined period of time that the system reacts. This can be true for one or both thresholds, $F_1$ and $F_2$, on the condition that the force must be exceeded during a certain period of time in one or more of the comparing steps (S4, S7, S9 or the corresponding).

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A controller for use in a washer for washing and dewatering cellulosic pulp material comprising a rotary drum including a plurality of axial compartment walls extending along said rotary drum so as to create a plurality of external axial compartments for washing said cellulosic pulp material, a stationary cylindrical casing enclosing said rotary drum thereby defining a ring-shaped space between said rotary drum and said stationary cylindrical casing, a plurality of axially extending seals disposed along said rotary drum thereby dividing said ring-shaped space into a plurality of zones for feeding, washing and discharging said cellulosic pulp material, said controller comprising a force sensor for sensing a force acting on at least one of said, plurality of axially extending seals in a direction outwardly from said rotary drum and a seal positioning member for moving said at least one of said plurality of axially extending seals in the radial direction with respect to said rotary drum in a predetermined pattern based upon the force measured by said force sensor.

2. The controller of claim 1 wherein said seal positioning member is adapted to reverse the direction of movement of said at least one of said plurality of axially extending seals a predetermined distance when the force measured by said force sensor exceeds a contact threshold force.

3. The controller of claim 2 wherein said seal positioning member is adapted to move said at least one of said plurality of axially extending seals in a direction towards said rotary drum based on a comparison of said force measured by said force sensor and a first contact threshold force and reverse said at least one of said plurality of axially extending seals a first predetermined distance when said first contact threshold force has been exceeded in a first mode of operation, and to reverse said at least one of said plurality of axially extending seals a second predetermined distance when said force measured by said force sensor exceeds a second contact threshold force.

4. The controller of claim 2 wherein said seal positioning member is adapted to reverse said at least one of said plurality of axially extending seals when said force measured by said force sensor exceeds at least one of said first and second contact threshold forces for a predetermined period of time.

5. The controller of claim 1 comprising at least two of said force sensors associated with said at least one of said plurality of axially extending seals, and at least two corresponding seal positioning members associated therewith, and including a pivoted connection between each of said seal positioning members and said at least one of said plurality of axially extending seals, whereby different portions of said at least one of said plurality of axially extending seals can be moved independently with respect to said other of said plurality of axially extending seals.

6. The controller of claim 1 wherein said force sensor comprises a load cell.

7. The controller of claim 1 wherein said seal positioning member comprises a holder for holding said at least one of said plurality of axially extending seals in a radial position with respect to said rotary drum and a drive member for driving said at least one of said plurality of axially extending seals by driving said holder.

8. The controller of claim 7 wherein said seal positioning member further comprises a spring force member in cooperative association with said driving member, whereby said spring force member becomes active when said driving member has reached a predetermined maximum capacity.

9. The controller of claim 1 wherein said seal positioning member is adapted to move said at least one of said plurality of axially extending seals based on at least one pressure associated with said at least one of said plurality of axially extending seals.

10. The controller of claim 1 including a control member for collecting the force measured by said force sensor and transmitting a control signal based thereon to said seal positioning member.

11. A washer for washing and dewatering cellulosic pulp material comprising a rotary drum including a plurality of axial compartment walls extending along said rotary drum so as to create a plurality of external axial compartments for washing said cellulosic pulp material, a stationary cylindrical casing enclosing said rotary drum thereby defining a ring-shaped space between said rotary drum and said stationary cylindrical casing, a plurality of axially extending seals disposed along said rotary drum thereby dividing said ring-shaped space into a plurality of zones for forming, washing and discharging said cellulosic pulp material, and a controller comprising a force sensor for sensing a force acting on at least one of said plurality of axially extending seals in a direction outwardly from said rotary drum and a seal positioning member for moving said at least one of said plurality of axially extending seals in the radial direction with respect to said rotary drum in a predetermined pattern based on the force measured by said force sensor.

12. A method for controlling a washer for washing and dewatering cellulosic pulp material comprising a rotary drum including a plurality of axial compartment walls extending along said rotary drum so as to create a plurality of external axial compartments for washing said cellulosic pulp material, a stationary cylindrical casing enclosing said rotary drum thereby defining a ring-shaped space between said rotary drum and said stationary cylindrical casing, a plurality of axially extending seals disposed along said rotary drum thereby dividing said ring-shaped space into a plurality of zones for forming, washing and discharging said cellulosic pulp material, said method comprising measuring a force acting on at least one of said plurality of axially extending seals in a direction outwardly from said rotary drum and moving said at least one of said plurality of axially extending seals in a radial direction with respect to said rotary drum in a predetermined pattern based on the force measured by said force sensor.

13. The method of claim 12 wherein said moving of said at least one of said plurality of axially extending seals comprises reversing the direction of movement of said at least one of said plurality of axially extending seals a predetermined distance when said measured force exceeds a contact threshold.

* * * * *